United States Patent [19]

Podosek

[11] Patent Number: 4,600,346

[45] Date of Patent: Jul. 15, 1986

[54] BINDER COVER AND METHOD OF MANUFACTURE THEREOF

[75] Inventor: Edward Podosek, Wilbraham, Mass.

[73] Assignee: Dennison National Company, Holyoke, Mass.

[21] Appl. No.: 800,788

[22] Filed: Nov. 22, 1985

[51] Int. Cl.[4] ..... B42C 7/00; B42C 1/00; B42D 3/00; B31B 1/00

[52] U.S. Cl. ..... 412/3; 412/17; 493/110; 281/35

[58] Field of Search ..... 412/3, 17, 19, 20, 21, 412/22, 24; 281/29, 20, 35; 493/946, 110; 156/201, 204, 227, 269

[56] References Cited

U.S. PATENT DOCUMENTS

| | | | |
|---|---|---|---|
| 1,591,061 | 7/1926 | Smith | 493/110 |
| 1,762,703 | 6/1930 | Smith | 493/110 |
| 2,646,914 | 7/1953 | Claff et al. | 493/110 |
| 2,970,634 | 2/1961 | Hantscho | 412/17 |
| 3,899,381 | 8/1975 | O'Brien et al. | 156/227 |

*Primary Examiner*—Paul A. Bell
*Assistant Examiner*—Paul M. Heyrana
*Attorney, Agent, or Firm*—Chapin, Neal & Dempsey

[57] ABSTRACT

Loose-leaf binder cover has a unitary web of thermoplastic sheet material wrapped about and adhesively bonded to the opposite surfaces of a plurality of stiffener panel inserts with the longitudinal side edge of the sheet material being overlapped. The panels include a back panel and a pair of rectangular cover panels laterally spaced apart, one from the others. The upper and lower edges of the binder consist of portions of the sheet material turned over the edges of the panel inserts. The other edge portions of the sheet material disposed about the inserts are welded together to fully encase the panel inserts within the sheet material. At locations between adjacent inserts, opposed portions of the sheet material are also welded together to provide hinge lines for the binder between the back panel and cover panels thereof. The method of manufacturing the above described loose-leaf binder cover is also disclosed.

8 Claims, 6 Drawing Figures

BINDER COVER AND METHOD OF MANUFACTURE THEREOF

BACKGROUND OF THE INVENTION

For many years it has been to conventional practice to fabricate better quality binder covers by using a three-ply construction. Three rigid or semi-rigid rectangular insert panels in spaced relation are sandwiched between two superposed sheets of thermoplastic sheet material and the peripheral edges of the plastic sheets are heat-sealed together. Of the three insert panels generally used in this process, two approximate in size, the cover panels of the binder and the third panel is a narrower insert or strip disposed between the two larger panels to form the back panel or spine of the binder. The outer plastic sheets, which are slightly larger than the inserts, are fused transversely in the areas between the adjacent edges of the back panel insert and the two cover panels as well as about their marginal edges. The transverse seals form the hinges for the binder cover and the peripheral edge seals provide the finished edges thereof. This method is disclosed, for example, in U.S. Pat. No. 3,195,924 dated July 20, 1965 to Carter and U.S. Pat. No. 4,216,046 dated Aug. 5, 1980 to Hackert. Although binder covers of this type have proven satisfactory over the many years of their use, it has been found that the plastic seals on the lower edges of the binders tend to deteriorate in a substantially shorter period of time than the remainder of the outer casing material. The reason for this is that the lower sealed edges of the binder are subjected to significantly greater wear on book shelves, desks and the like. Moreover, the plastic edges, which have been sealed, tend to be more brittle and less durable than the very same plastic material which has not been subjected to such processing.

Another conventional method of fabricating binder covers has been known as the "case made technique", sometimes called "the turned edge construction." As early example of this type of construction was disclosed in U.S. Pat. No. 2,024,881 dated Dec. 17, 1935 to Schade. Three patents to Peterson, et al also disclose this type of casing for books; these are U.S. Pat. Nos. 3,190,678, dated June 22, 1965; 3,215,450, dated Nov. 2, 1965 and 3,277,505, dated Oct. 11, 1966. In this method, an outer covering material is applied onto the outer surfaces of the binder inserts and turned over the outer edges of the inserts where the material is sealed or glued. An inside liner sheet is then applied and glued over the inturned edges of the outer cover sheet. This construction does not, however, lend itself to automated production techniques.

In less expensive loose-leaf binders, covers are sometimes made as a single ply construction. In this type of product, a semi-stiff plastic sheet material is die-cut to form a one piece cover with hinge lines stamped into the plastic sheet. While binder covers of this type have achieved commercial acceptance for some limited purposes, they have not displaced the three-ply construction used in the better quality binders.

SUMMARY OF THE INVENTION

Loose-leaf binder covers which embody this invention are of the three-ply type but yet overcome the drawbacks of the prior art in regard to the durability of such products. The binders utilize a unitary web of synthetic plastic sheet material which is folded or wrapped around stiffener panels. Only the side edge and hinge line portions of the outer sheet material are fused or welded together. This means that the upper and lower edges of the outer casing material are turned edges, that is the plastic sheet material is folded over the insert panels and is thus not subjected to any processing or treatment which would tend to degrade or change its inherent properties. Such degradation occurs during plastic sealing or welding of vinyl plastics. In this connection, it has been found that when two plastic sheets are sealed together, the composite thickness which results is substantially less than the total thickness of the two sheets before the sealing process. In addition, heat-sealing tends to make the sealed portion more brittle than before heat-sealing because the more volatile plasticizers used in such vinyl materials are vaporized. Finally, in the heat-sealing operation adjacent the edge of an insert panel, the plastic sheets are invariably stretched to some extent so that the plastic in these areas is thinner than the unsealed vinyl. The binder covers embodying this invention are superior to those of the prior art since their upper and lower edge portions are not subjected to heat-sealing procedures.

It is the principal object of this invention to provide an improved binder cover of multi-ply construction in which a unitary sheet of thermoplastic encases a plurality of spaced stiffener panels.

It is another object of this invention to provide an improved method of manufacturing binders of the above type.

It is also an object of this invention to provide a binder of the above type having a file pocket formed during the manufacturing process and in which a minimum of plastic sheet material is required.

The above and other objects and advantages of this invention will be more readily appreciated with reference to the accompanying drawings in which.

Figure 1:
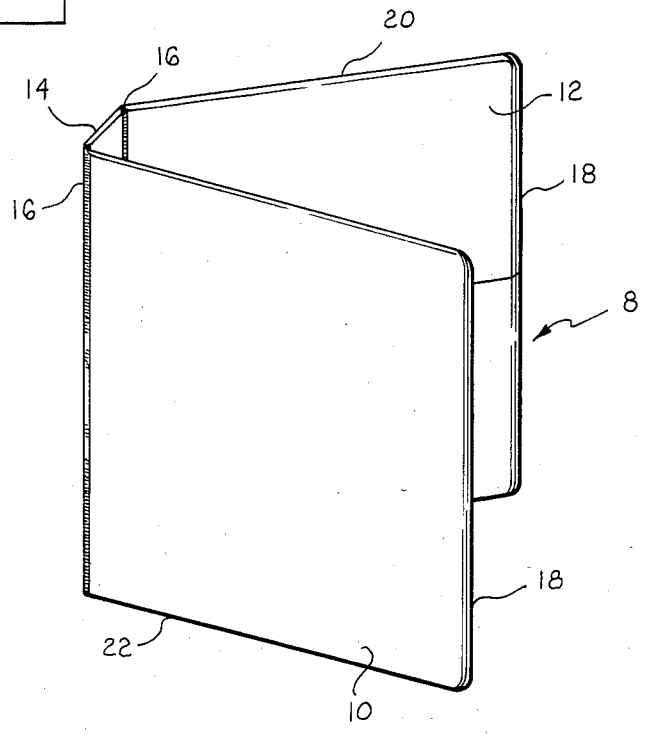
FIG. 1 is an overall perspective view of a notebook cover of the type embodying this invention.

In FIG. 1 is shown a notebook cover or folder 8 which has hinged front and rear cover panels 10 and 12 and a back panel or spine 14. A pair of parallel, laterally spaced hinge lines 16 extend laterally from the top edge 20 to the lower edge 22 of the cover. The outer side edges 18 of the cover are welded or sealed together by heat or radio frequency (rf) sealing, as will hereinafter be more fully described. A conventional ring mechanism (not shown) may be affixed to the inner surface of the back panel 14 whereby the cover would form part of a ring binder or loose-leaf notebook.

Figure 2:
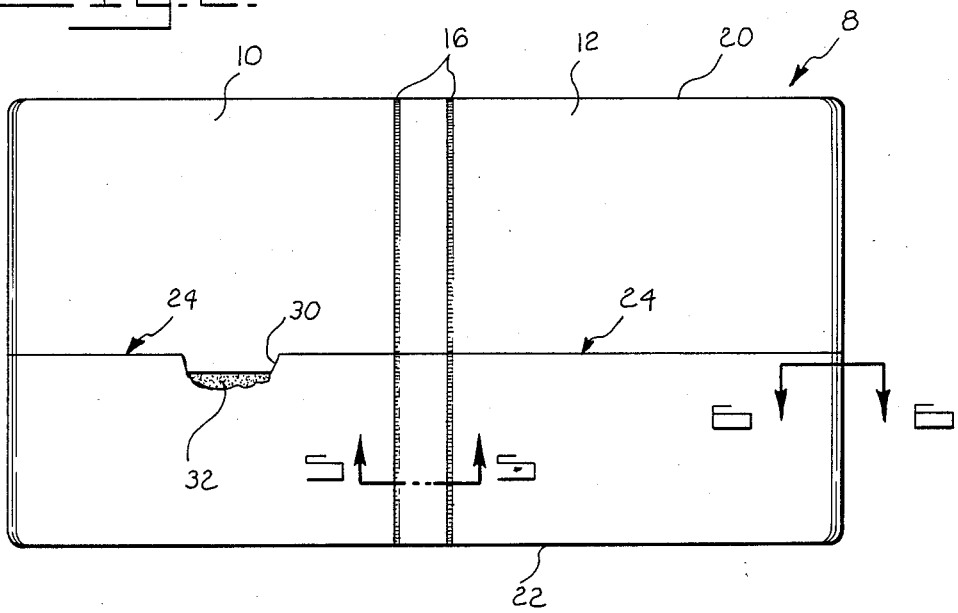
FIG. 2 is a view showing the inside of the cover of FIG. 1 with the cover fully opened and its panels disposed in coplanar relationship.

As best illustrated in FIG. 2, upwardly-opening file pockets 24 extend across the inside surfaces of each of the cover panels 10 and 12.

The cover 8 is a multi-ply construction comprising a flexible outer skin or sheathing material 30 (FIGS. 2 and 3) which wholly encases or encapsulates two rectangular insert cover panels 32 and a back panel insert 36 (FIG. 3) which impart, form and substance to the composite cover. A portion of one of the insert panels is also shown at 32 in FIG. 2.

The sheathing material is preferably a synthetic plastic sheet material or film such as a polyvinyl chloride copolymer which can be sealed or welded to itself to encase therein the stiffener panel inserts.

Three rigid or semi-rigid, rectangular panels 32 and 36 of fiber or chip board, for example, are sandwiched between layers of plies of the web of outer sheathing material to provide a three-ply laminate structure. The panels are selected to provide a cover of pretermined configuration and other desired properties of stiffness, resilience and the like.

A multi-ply cover embodying this invention may be fabricated in an automated, continuous assembly line technique. In this connection, a web 38 (FIG. 3) of synthetic plastic material 30 may be withdrawn from a large roll 40 of a suitable plastic material and advanced along a given path, such as on a horizontal conveyor (not shown). The width w of the web 38 utilized is at least twice the height h (FIG. 4) of the binder covers being fabricated.

Figure 3:
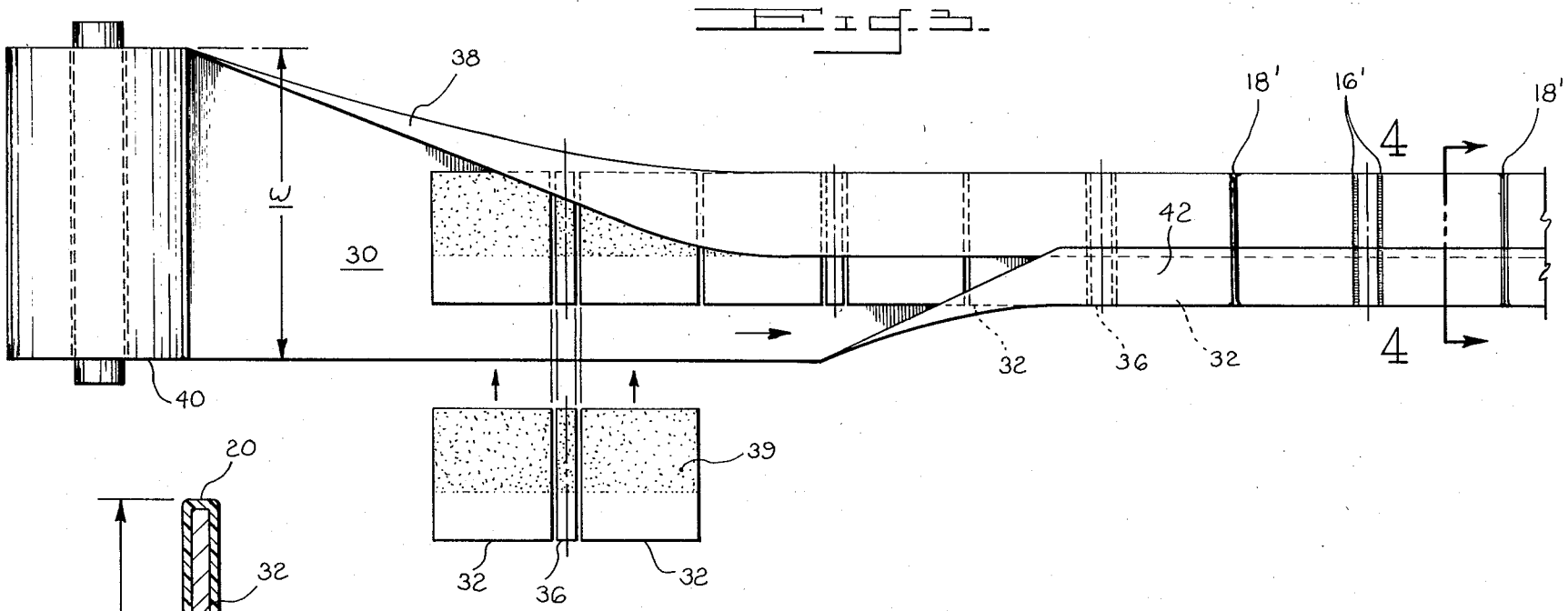
FIG. 3 is a diagrammatical view illustrative of steps of an automated process for making notebook covers embodying this invention.

Sets of three inserts 32 and 36, laterally spaced apart, as shown in FIG. 3, are in intermittently advanced onto the surface of the web of material 30 as it moves past a panel loading station. Preferably, the opposite surfaces of the insert panels are precoated with a liquid adhesive material 39 so that the outer covering material 30 will uniformly adhere thereto. It will be recognized by those skilled in the art that instead of precoating the insert panels, the upper surface of the web may be spray-coated with a suitable adhesive for bonding the insert panels to the web material.

The opposite side edge portions of the web 38 are folded inwardly so as to completely enclose the insert panels and the lower edge portion 42 of the sheet is lapped slightly over the down turned upper edge portion, as shown in FIG. 3. As it is being folded, the web is uniformly tensioned so as to uniformly and smoothly cover the insert panels. When this assembly has been carried out, the opposed surface portions of the plastic sheet material located between the adjacent spaced edges of the panel inserts are heat-sealed or welded together, as illustrated at 16' and 18' in FIG. 3. These narrow sealed areas or zones correspond to the hinges 16 in FIG. 1 and the outer edges 18 of the binder cover 8. With the sealing of the edge portions 18, they are simultaneously severed to form a unitary cover 8.

Figure 4:
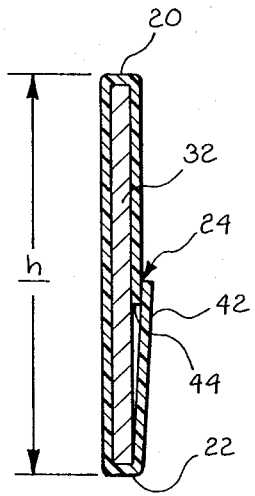
FIG. 4 is a sectional view taken along line 4—4 of FIG. 3.

An important feature of this invention is that the upper and lower edges of the binder cover 20 and 22 are formed by folding the web of sheet material 30 over the outer edges of three insert panels 32 and 36, as shown in FIG. 4. The result is that there is no sealed edge or bead along these edges and the vinyl sheet material, especially along the lower edge 22 of the cover, has a substantially longer wear life than a binder cover which is sealed along this edge.

The lower edge portion 42 of the cover material 30 is preferably not glued to the insert panel 32 and, as best shown in FIG. 4, pockets 24 are thus formed between the lower edge portion 42 of the plastic cover sheet 30 in the area where it overlaps the opposite edge 44 of the outer sheet 30. The advantage of this construction is that file pockets are formed automatically with a minimum of material 30 when the web 38 is wrapped about and bonded to the insert panels. Of course, if desired, the inner ply of the sheet material may be glued over the entire surface areas of the inserts so that lower edge 44 will extend approximately to the lower edges of inserts 32 (FIG. 4). With this construction, the inner surface of the pockets 24 will be lined with the cover material.

Figure 6:
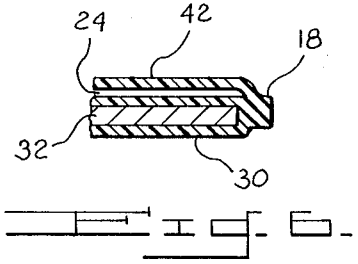
FIG. 6 is a sectional view taken along line 6—6 of FIG. 5.
Figure 5:
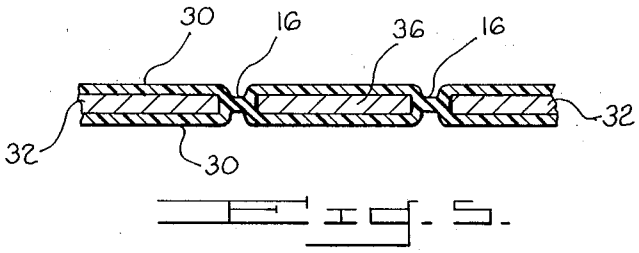
FIG. 5 is a sectional view taken along line 5—5 of FIG. 2.

As best illustrated in FIG. 5, the hinge lines 16 and 18 located between the back panel 36 and the cover panels 32 consist of the upper and lower plies of sheet material 30 which have been fused or welded together by heat or radio frequency sealing. Similarly, the upper and lower plies of the plastic cover sheet 30 between adjacent edges of successive pairs of cover sheets are also sealed together, as illustrated at 18 in FIG. 6. Simultaneously, the outer side edge of the lower flap portion 42 of the sheet 30 is also fused or welded to the side edge seals of the binder cover. Thus, the side edges of the pocket forming flaps are bonded along the edge seals 18 to define the upwardly opening file pockets 24.

It may also be deemed advantageous to provide an inturned hem or edge seal along the upper edge of the pockets. This option will provide a rounded edge or bead which will give the product a more finished look and facilitate the insertion of papers into the pocket. In addition, this type of finished edge will strengthen the edge against wear and tear and will even assist in frictionally retaining loose papers within the pocket.

Having thus described this invention, what is claimed is:

1. Multi-ply cover for binders having a back panel and rectangular front and rear cover panels with hinge lines for swinging movement of the cover panels relative to the back panel, said cover panels being defined by transverse side edges and upper and lower longitudinal edges, said cover comprising a unitary sheet of heat-sealable, thermoplastic material, a plurality of laterally spaced rectangular inserts encased between opposed layers of said unitary sheet folded about at least one of said longitudinal edges and fused together along said outer side edges and along said hinge line, said inserts being sufficiently rigid to impart form stability to said cover and being encased within said sheet material.

2. Multi-ply cover for binders as set forth in claim 1 in which said sheet material is folded about both said longitudinal edges and said rectangular inserts include a pair of rectangular cover panel inserts spaced laterally from a back panel insert.

3. Multi-ply cover for binders as set forth in claim 2 in which said unitary sheet of thermoplastic material is wrapped around said inserts and the opposite edges thereof are overlapped inside the binder cover.

4. Multi-ply cover for binders as set forth in claim 3 in which a lower edge portion of said sheet material overlaps an upper edge portion and forms a file pocket within the cover of the notebook.

5. Multi-ply cover for binders as set forth in claim 3 in which said sheet material is adhesively bonded onto opposite surface portions of said inserts.

6. Multi-ply cover for binders as set forth in claim 5 in which the lower edge portion of said sheet material is bond free in relation to at least one of said cover panels to provide said file pocket.

7. Multi-ply cover for binders as set forth in claim 6 in which the inside surfaces of said cover panels are defined by an upper portion of said sheet material being bonded onto at least an upper fractional portion of the insert cover panels, the lower portion of said sheet material extending upwardly and overlapping the upper portion of said sheet material without being bonded to the corresponding portions of said insert cover panels, the lower portion of said sheet material being fused to superimposed layers of said sheet material only at the transverse side edges and hinge line portions of said cover.

8. Method of fabricating a cover for binders comprising the steps of wrapping a unitary web of heat-sealable thermoplastic sheet material about a plurality of sets of laterally spaced rectangular inserts being advanced along a predetermined path, each set comprising a pair of cover panel inserts and a back panel insert, adhesively bonding said web to the opposite surfaces of said inserts to fully encase said inserts within opposed layers of said sheet material, fusing together the opposed portions of said sheet material in the areas at which the inserts are spaced apart to form sealed hinge lines and sealed side edges for each set of inserts and upon fusing said sheet material, successively serving the leading set of plastic-encased panels from the next set to form sequentially said covers.

* * * * *